US008464562B1

(12) United States Patent
Colburn et al.

(10) Patent No.: US 8,464,562 B1
(45) Date of Patent: Jun. 18, 2013

(54) GARMENT STEAMER

(76) Inventors: Michael G. Colburn, Burlington, VT (US); David R. McCloskey, Burlington, VT (US)

( * ) Notice: Subject to any disclaimer, the term of this patent is extended or adjusted under 35 U.S.C. 154(b) by 0 days.

(21) Appl. No.: 13/437,556

(22) Filed: Apr. 2, 2012

(51) Int. Cl.
*D06F 7/00* (2006.01)
*D06F 75/00* (2006.01)

(52) U.S. Cl.
USPC ..... 68/222

(58) Field of Classification Search
USPC ..... 68/222
See application file for complete search history.

(56) References Cited

U.S. PATENT DOCUMENTS 2,214,923 A * 9/1940 Glover, Jr. ..... 223/51
3,594,917 A * 7/1971 Montgomery ..... 34/621
3,601,292 A * 8/1971 Bliss ..... 68/6
3,752,373 A * 8/1973 Smith ..... 223/51
5,373,582 A * 12/1994 Dragone et al. ..... 2/2.5
5,730,006 A * 3/1998 Conley ..... 68/6
6,622,529 B1 * 9/2003 Crane ..... 68/5 C
7,903,956 B2 3/2011 Colburn et al.
2006/0090524 A1 * 5/2006 Jeon et al. ..... 68/135
2010/0086287 A1 * 4/2010 Rosenzweig et al. ..... 392/387
2011/0266272 A1 11/2011 Colburn et al.

* cited by examiner

*Primary Examiner* — Michael Barr
*Assistant Examiner* — Jason Ko
(74) *Attorney, Agent, or Firm* — Thomas G. Ference

(57) ABSTRACT

An apparatus for steaming a garment comprising an expandable enclosure having a wall circumscribing a hollow space therein, the hollow space accessible through a re-closeable opening in the wall. A clothes hanging element and stretch element contained within the hollow space, the clothes hanging element for holding the garment and the stretch element for stretching the garment. A steam generator connected to provide steam to the hollow space. The steam generator has a water reservoir chamber and a steam chamber with a partition there between. At least one pair of electrodes is arranged within the steam chamber to provide an electric current that resistively heats a source of water to create steam. A water communication port in the partition allows water to pass from the water reservoir chamber to the steam chamber in a manner that self-regulates the amount of steam generated.

27 Claims, 8 Drawing Sheets

GARMENT STEAMER

FIELD

This patent application generally relates to an apparatus for steaming a garment. More specifically it relates to an apparatus that comprises an expandable enclosure in which to hang and stretch a garment, the enclosure is connected to a steam generator which holds a measured amount of water that is converted to steam by passing electric current through the water thereby filling the enclosure with steam.

BACKGROUND

Garments can become wrinkled from folding or packing and then storing the garment in a drawer, on a shelf or in a suitcase. Garments can also acquire unpleasant odors from exposure to body odor, mildew, mold or other contaminating exposures. Travelers are especially burdened with these problems as they are forced to either wear wrinkled clothes or take time to iron or hand steam the garments after unpacking. On long trips, odors may further build up when reusing clothes. In this situation the traveler has to take time to wash, iron, steam or refreshen the clothes. Packing devices that perform these tasks or finding access to them at the point of travel adds another level of hassle and planning. Even if these devices are readily available, they create their own set of problems.

For example, the use of an iron is very labor intensive when trying to remove wrinkles. The iron must be repeatedly pressed over a wrinkle in a garment using pressure and possibly steam from the iron to remove the wrinkle. The operator must make contact with all surface areas of the garment from which to remove the wrinkles. Often the process of removing a wrinkle will create a new crease in a layer below the layer being worked on. Irons are very hot and known to start fires when left unattended. Irons require the use of heat resistant surfaces such as an ironing board that is capable of holding the garment and withstanding the heat of the iron. Irons are also prone to building up lime deposits on heated surfaces or heating elements requiring maintenance, repair costs or the purchase of a new iron.

Handheld steamers are similar to irons in that the operator must maneuver garments into position to be contacted by the emitted steam in order to remove the wrinkles. This process requires all wrinkled surfaces of the garment to be treated by the operator requiring a great deal of labor and time. Handheld steamers typically get very hot and can also build up lime deposits requiring maintenance and cost. Wand-held steamers can become uncomfortable to hold due to the heat from the steam generating elements and the steam itself.

The present application improves upon the current state of the art wrinkle removing and refreshing appliances to provide a new apparatus that combines wrinkle removing and refreshening into one simple apparatus that requires minimal effort and time of the user.

SUMMARY

One aspect of the present patent application is directed to an apparatus for steaming a garment comprising an expandable enclosure having a wall circumscribing a hollow space therein, the hollow space is accessible through a re-closeable opening in the wall. A clothes hanging element is contained within the hollow space for holding the garment. A stretch element is contained within the hollow space for stretching the garment. A steam generator is connected to provide steam to the hollow space.

Another aspect of the present patent application is directed to an apparatus for steaming a garment that can be compactly packed, but can then be expanded and hung in a closet where once the steaming process is initiated the apparatus can operate unattended without concern.

Still another aspect of the present patent application is directed to an apparatus for generating steam that can self-generate steam quickly from a small amount of water and then re-supply the water to create steam over a period of time for extended steaming.

Still yet another aspect of the present patent application is directed to an apparatus for generating steam comprising a water reservoir chamber for holding a source of water and entrapped air. The apparatus further comprises a steam chamber adjacent to the water reservoir with a partition between the water reservoir chamber and the steam chamber. A water communication port is provided in the partition to allow water to pass from the water reservoir chamber to the steam chamber. At least on pair of electrodes is provided within the steam chamber, each pair of electrodes arranged for providing electric current through the source of water to generate steam.

BRIEF DESCRIPTION OF DRAWINGS

The foregoing and other aspects and advantages presented in this patent application will be apparent from the following detailed description, as illustrated in the accompanying drawings, in which.

DETAILED DESCRIPTION

Figure 1:
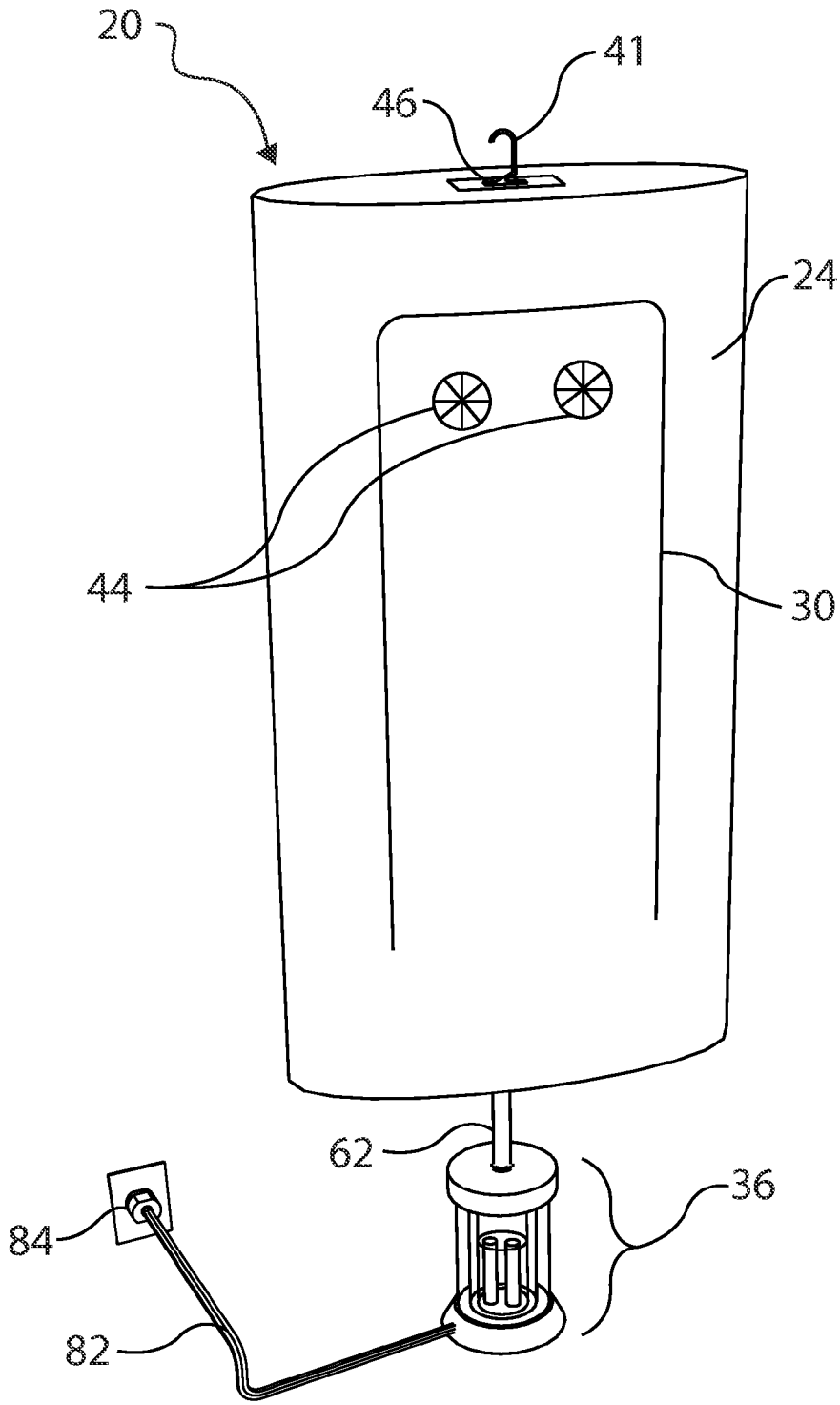
FIG. 1 is a front perspective view of one embodiment of an apparatus for steaming a garment according to the present patent application, the apparatus is shown in an expanded state and ready for accepting a garment to be steamed.

FIGS. 1 through 8 illustrate an apparatus 20 (a.k.a. garment steamer 20) for steaming a garment 22. Garment steamer 20 comprises an enclosure 24 having a wall 26 circumscribing a hollow space 28 therein. Enclosure 24 includes a back 21, sides 23*a* and 23*b*, front 25 and length 27. Hollow space 28 is accessible through a re-closeable opening 30 in wall 26. A clothes hanging element 32 resides within hollow space 28 for supporting garment 22 within the hollow space. At least one stretch element 34 is provided for stretching garment 22. A steam generator 36 is connected with enclosure 24 for providing steam 38 to hollow space 28 where the steam can act upon the fabric that garment 22 is made of to remove wrinkles 40. An enclosure hanging element 41 may be further provided for hanging garment steamer 20 within a closet, on a shower curtain bar or over a door.

FIG. 1 illustrates an external view of the major components of garment steamer 20. Enclosure 24 may take the shape of a garment bag. Enclosure 24 is preferably made of a breathable material that allows moisture to pass through wall 26 of the enclosure. Examples of materials that may be used to construct enclosure 24 are Nylon #6, Nylon Ripstop or other similar breathable and steam-temperature tolerant materials. Enclosure 24 is expandable so as to create a gap 42 between wall 26 and garment 22 when steam 38 is present in the enclosure. Having a gap 42 between wall 26 and garment 22 helps to keep any condensed water on the inside of the wall away from the garment and also eliminates any pressure points on the garment from the wall that might cause the formation of new wrinkles. Re-closeable opening 30 is provided in one face of enclosure 24 so that the user may easily place and remove garment 22 from within hollow space 28. Re-closeable opening 30 is generally kept closed during the steaming process, but may be left open when drying enclosure 24. Re-closeable opening 30 may be fitted with fasteners such as snaps, VELCRO®, a zipper or an interlocking seal to aid in opening and closing. Enclosure 24 may further include one or more pressure relief ports 44 to limit the amount of pressure that is built up by steam 38 during the steaming process.

Figure 2:
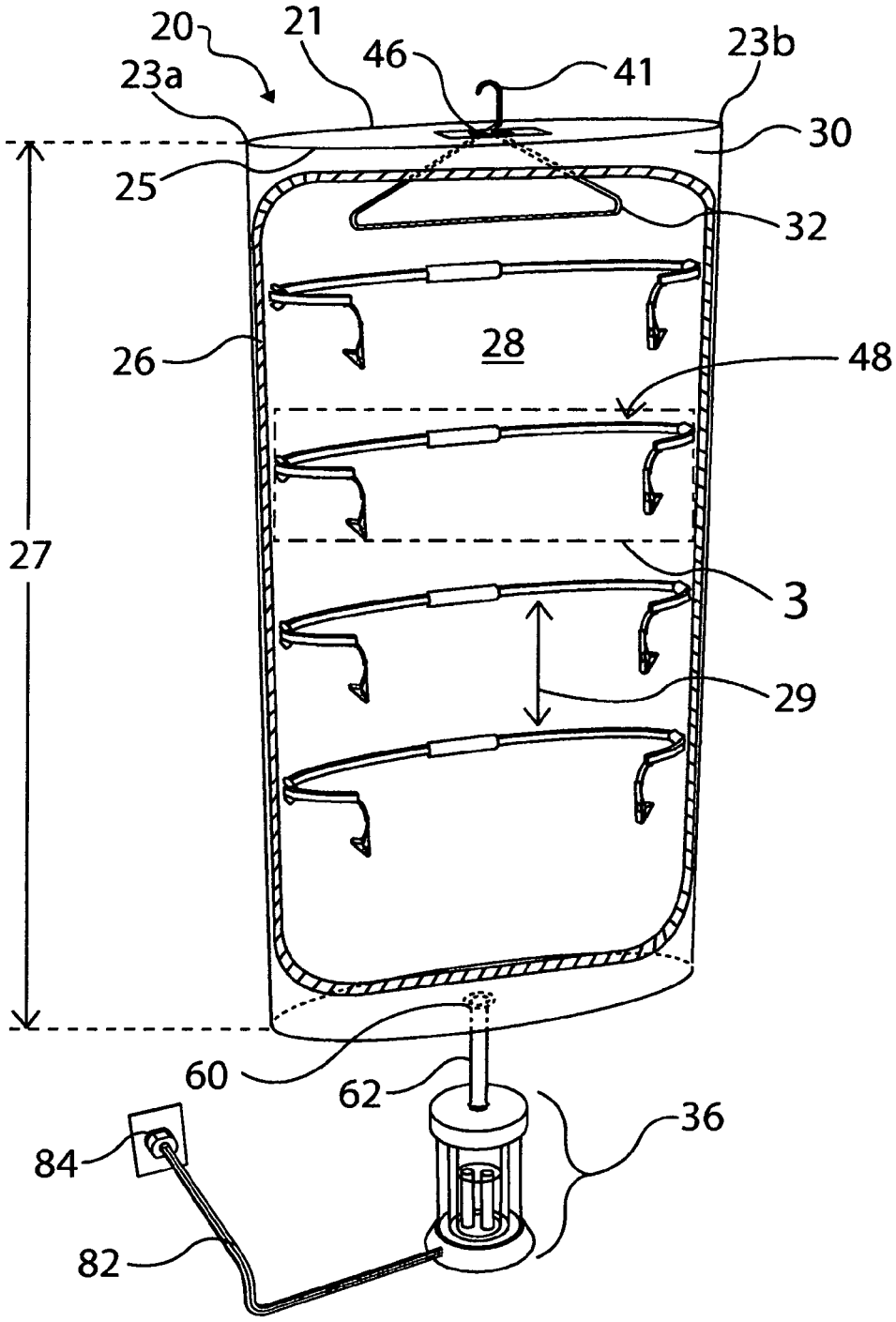
FIG. 2 is a front, partial sectional view of the apparatus for steaming a garment as shown in FIG. 1, this view shows the clothes hanging element and a plurality of stretch elements contained within the enclosure.

FIG. 2 illustrates an internal view of the major components of garment steam 20. Clothes hanging element 32 provides a structure for supporting garment 22. Clothes hanging element 32 may be affixed internal to enclosure 24 or be a separate element that can be moved in and out of the enclosure. In one embodiment, closes hanging element 32 and enclosure hanging element 41 are formed as one structure, such as a standard clothes hanger that has a hooked top attached to a wide support structure bottom. The hooked top acts as enclosure hanging element 41 and can pass through hanger opening 46 in wall 26 of enclosure 24. The wide support structure bottom portion acts as clothes hanging element 32.

Figure 3:
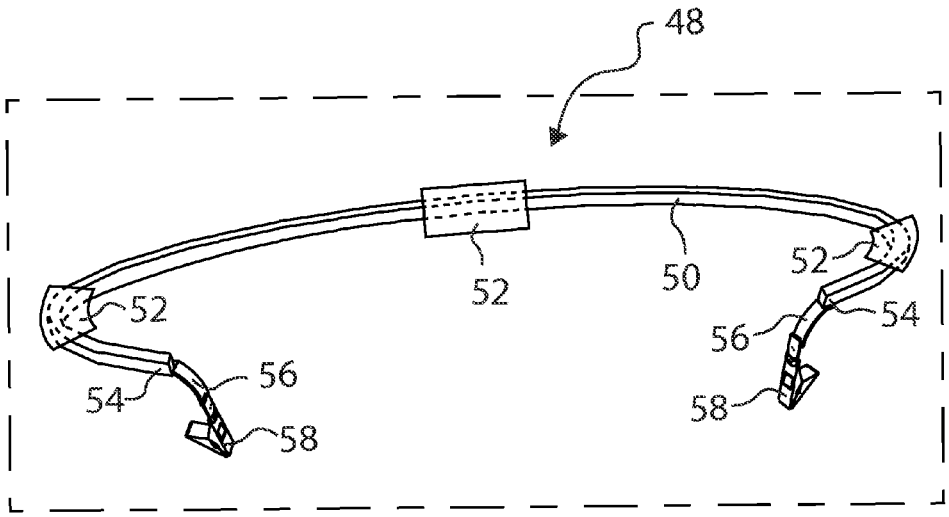
FIG. 3 is a enlarged view of one of the stretch elements of FIG. 2.

FIG. 3 illustrates a detailed view of one embodiment of stretch element 48. In general stretch element 48 is a structure that facilitates stretching of garment 22 when the garment is placed within enclosure 24. Stretch element 48 may be attached to the inside wall 26 of enclosure 24 or attached to clothes hanging element 32. Stretch element 48 may stretch garment 22 by residing on the inside of the garment and pushing the garment outward or the stretch element may reside outside garment 22 and pull or stretch the garment. Stretch element 48 may be one element that extends the length of garment 22 or the stretch element may be a plurality of stretch elements spaced periodically along the length of enclosure 24 with a spacing width 29, FIG. 2. Stretch element 48 may further be a collapsible stretch element or plurality of collapsible stretch elements that collapse in a manner to provide a compact structure when garment steamer 20 is not being actively used for steaming, FIG. 8. Spacing width 29 collapses and expands with the collapse and expansion of enclosure 24.

For the embodiment of stretch element 48 depicted in FIGS. 2 and 3, the stretch element includes a rib 50 that is designed to surround garment 22. Rib 50 is secured to the inside wall 26 of enclosure 24 by passing through one or more sleeves 52 affixed to the inside wall. Rib 50 terminates in two distal ends 54 near front 25 of enclosure 24. Rib 50 is bent to extend along back 21 and sides 23*a* and 23*b* of enclosure 24. An elastomeric strap 56 and clamping element 58 are attached to each rib 50. When garment 22 is placed within enclosure 24, clamping elements 58 are attached to the garment by the user. Elastomeric straps 56 provide a stretching force on the garment to straighten wrinkles 40. Rib 50 also aids in keeping inside wall 26 separated away from garment 22 to create gap 42.

Figure 4:
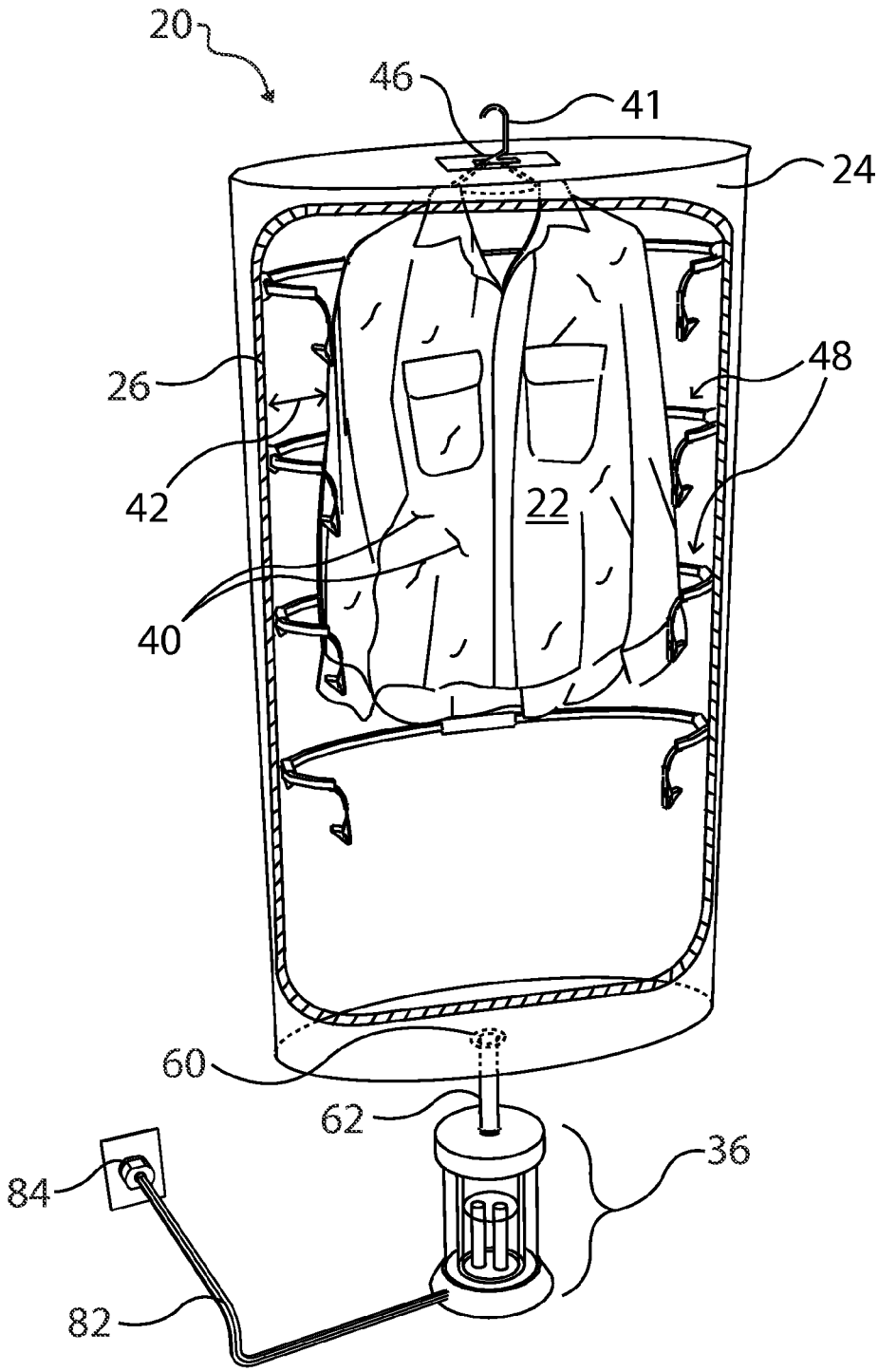
FIG. 4 is a front, partial sectional view of the apparatus for steaming a garment as shown in FIG. 1 with a garment now hung from the clothes hanging element.
Figure 5:
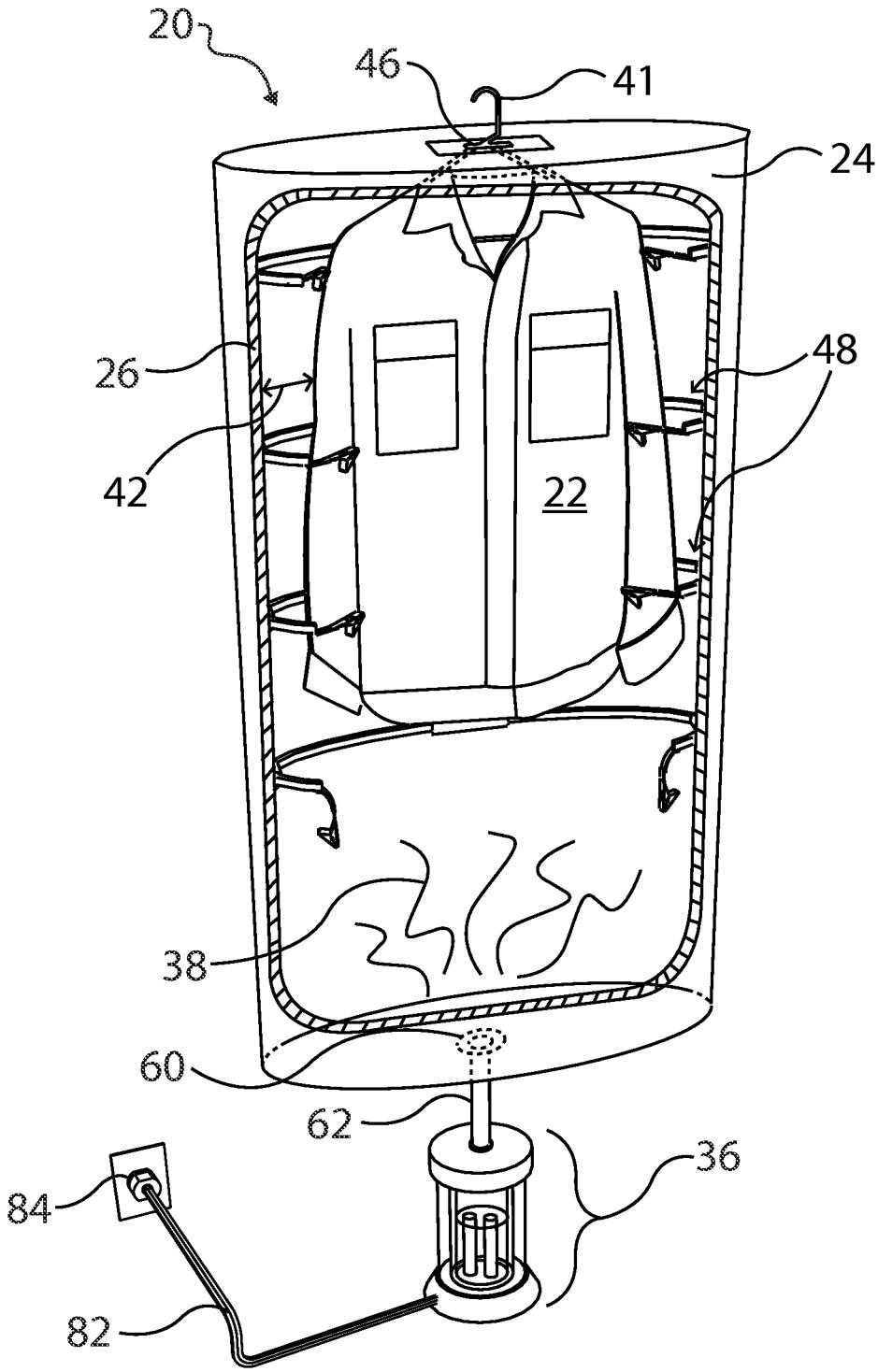
FIG. 5 is a front, partial sectional view of the apparatus for steaming a garment of FIG. 4 with the garment now stretched using the plurality of stretch elements.

FIGS. 4 and 5 illustrate how garment 22 is supported within enclosure 24 and how stretch elements 48 are secured to the garment's fabric to straighten the fabric. Once garment 22 is stretched by stretch elements 48, steam 38 is provided to hollow space 28 of enclosure 24 to act upon the fibers of the fabric and remove wrinkles 40.

FIGS. 1 and 5 illustrate a preferred embodiment of how to connect steam generator 36 to enclosure 24 and provide steam 38 for steaming garment 22. Although steam generator 36 is shown as residing outside of enclosure 24 and connected by a tube 62 to a steam port 60 in the enclosure, it is understood that other embodiments exist where steam generator 36 may reside within enclosure 24 and be connected in a way that still provides steam to hollow space 28. For example, steam generator 36 may be connected by hanging within or residing on the floor of enclosure 24 and emit steam 38 directly into hollow space 28.

Various types of steam generators, which work on different steam generation principles, may be used as the steam generating component of garment steamer 20. However, a preferred method of steam generation is disclosed in U.S. Pat. No. 7,903,956 to Colburn et al., titled "Rapid Liquid Heating", and U.S. patent application Ser. No. 13/023,891 to Colburn et al., titled "Steam Generator System"; the entire disclosure of both which are herein incorporated by reference.

Figure 6:
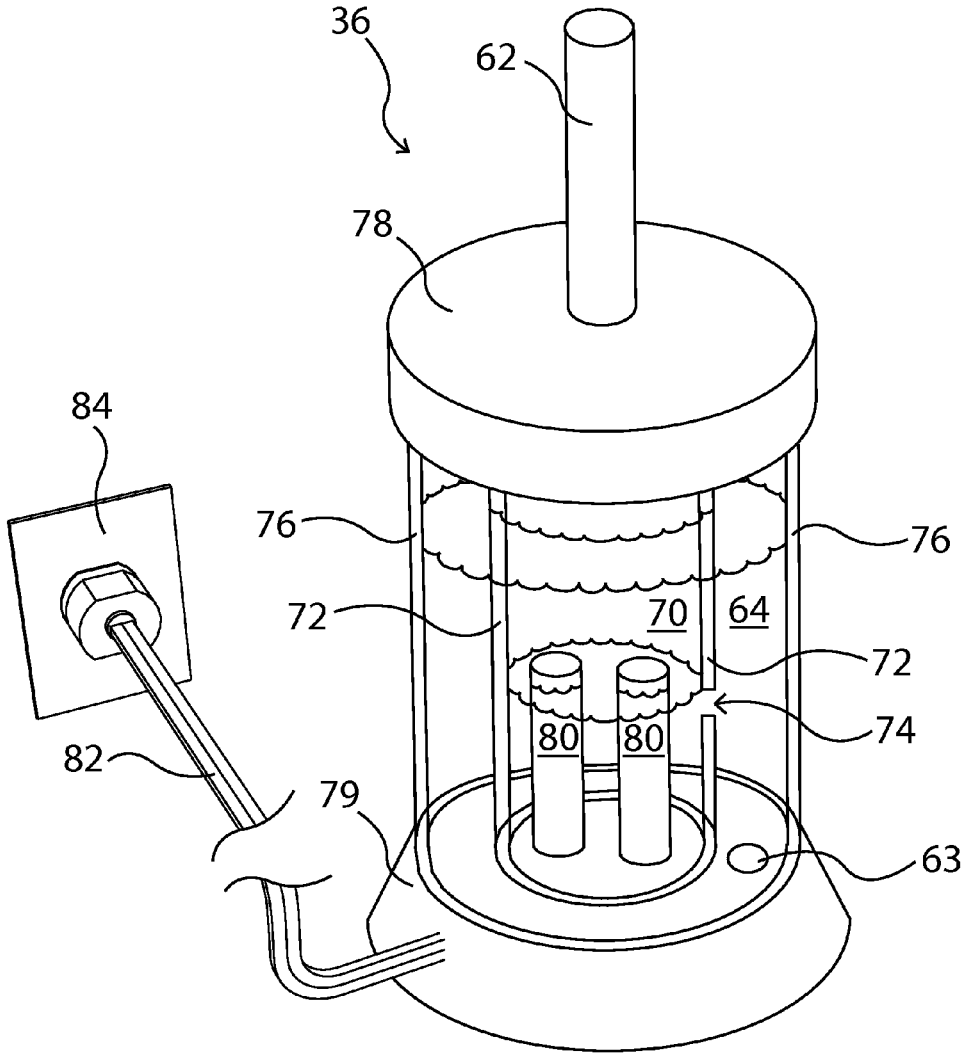
FIG. 6 is a front, perspective view of one embodiment of a steam generator used in conjunction with the apparatus for steaming a garment as shown in FIG. 1.
Figure 7:
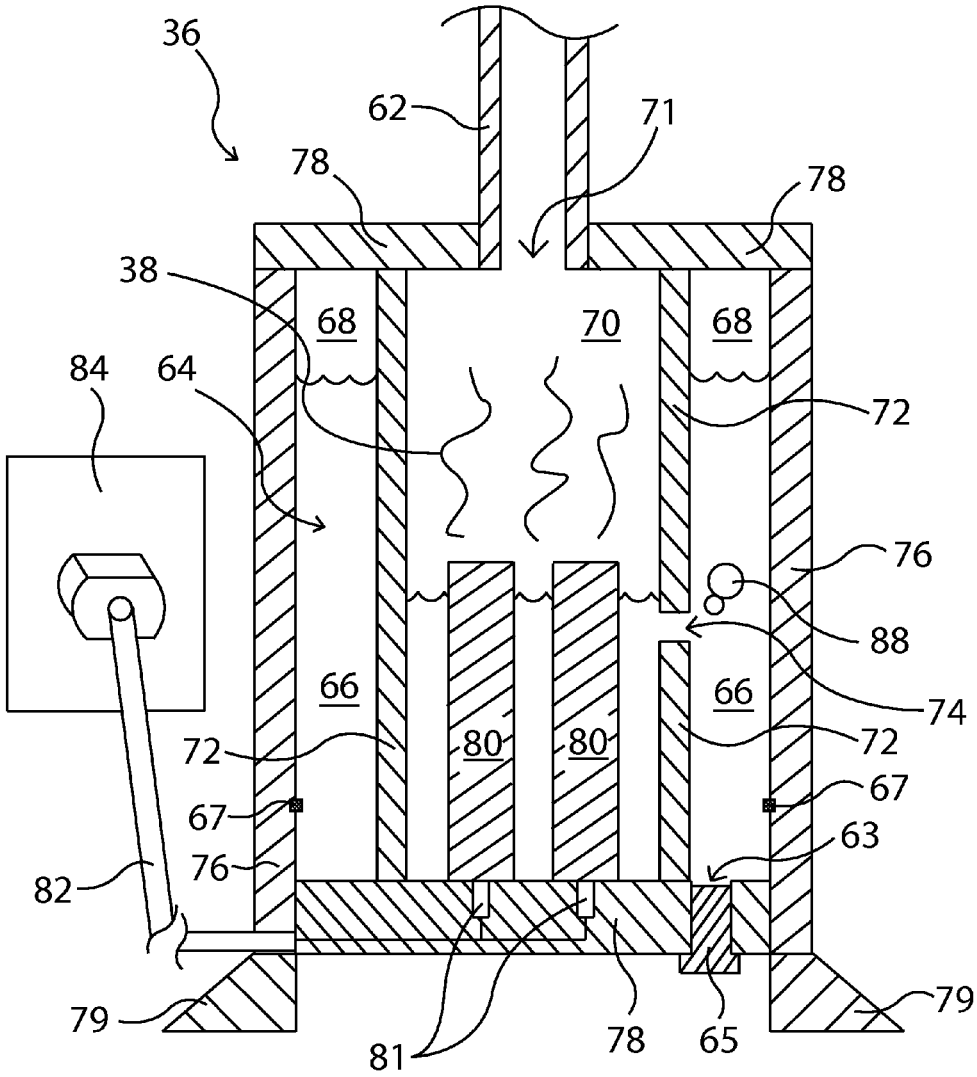
FIG. 7 is a sectional view of the steam generator shown in FIG. 6.

FIGS. 6 and 7 illustrate the components of a self-feeding steam generator 36 with a self-contained source of water 66. Steam generator 36 comprises a water reservoir chamber 64 for holding source of water 66 and entrapped air 68. Water reservoir chamber 64 includes a water filling port 63 and replaceable plug 65 for sealing the volume of water 66 and entrapped air 68. Water reservoir chamber 64 may include a water fill line 67 to aid the user in determining a measured amount of water 66 when filling the water reservoir chamber. Steam generator 36 further comprises a steam chamber 70 adjacent to water reservoir chamber 64. Steam chamber 70 holds water 66 transferred from water reservoir chamber 64 and any gases created during vaporization. Steam chamber 70 has a steam exit orifice 71. Steam exit orifice 71 may narrow to accelerate steam as it is directed out of steam chamber 70. A vertical partition 72 resides between water reservoir chamber 64 and steam chamber 70. A water communication port 74 is provided in vertical partition 72 for allowing water 66 to pass from water reservoir chamber 64 to steam chamber 70. In the embodiment depicted in FIGS. 6 and 7, steam chamber 70 is concentric to water reservoir chamber 64 creating a cylinder within a cylinder structure. This configuration creates an internal steam chamber 70 surrounded by an external water reservoir chamber 64. However, other structures such as two adjacent box-like chambers would also work. Water reservoir chamber 64 and steam chamber 70 are preferably created from a clear, electrically insulating material such as polycarbonate where the polycarbonate makes up both vertical partition 72 and outer wall 76. End caps 78, also made of an electrically insulative material such as polycarbonate, complete the formation of water reservoir chamber 64 and steam chamber 70. The use of a clear material in the construction of both chambers 64 and 70, allows the user to view water levels and steam generation. It is understood, however, that alternative materials could be used to create both chambers. Steam generator 36 may also include a base 79 for stabilizing and supporting the steam generator.

At least one pair of electrodes 80 is provided in steam chamber 70. Electrodes 80 are arranged for making contact with water 66 and providing electric current through the water when in contact with the water. Water communication port 74 is located vertically along vertical partition 72 at a vertical height that determines a set level of water contacting electrodes 80 as the source of water is fed from said reservoir chamber to said steam chamber. The set level of water determines a constant rate of steam generation. The electric current heats water 66 resistively and converts the water to steam 38. This type of direct heating of water 66 to generate steam 38 is very energy efficient with almost 100-percent of the electrical energy going to steam generation. This type of direct heating of water 66 also occurs very quickly with steam generation occurring shortly after electric current is applied. Power is supplied to electrodes 80 through two leads 81 that become a cable 82 that connects with a power source 84. Power source 84 has a defined potential that provides a source of electric current that is converted to heat within source of water 66. Power source 84 is typically a 120-volt power outlet, but could be a battery power source.

The rate at which steam 38 is generated in steam chamber 70 is a function of the applied potential and the amount of electric current flowing through water 66. Most standard power sources are constant voltage power sources and the electric current adjusts to meet the resistance of the load, in the present case the load is the resistance of the water being heated. Therefore to speed up the vaporization process and create steam 38 more quickly, the resistance of the water can be decreased. Decreasing the electrical resistance of the water is obtained by creating a higher ion concentration in source of water 66. To achieve a desired higher ionic concentration within source of water 66, an electrolytic material (e.g., ionic salt such as sodium chloride or potassium chloride) can be added to the water. The higher ionic concentration will speed up the steam generating rate over that of just using standard tap water. By adding ionic salts to water 66, the steam generation rate can be increased and the overall garment steaming process time reduced.

At the same time that an ionic salt is added to water 66, other chemicals may be added to act as freshening agents. Examples of freshening chemicals are sodium bicarbonate, nahcolite and sodium hydrogen carbonate. Additionally, fragrances or antistatic chemicals may also be added to the water. These chemicals are either volatilized and carried with steam 38 or carried in small condensate particles of the water that are generated during the steam generation process. Steam 38, other volatile chemicals and condensate water particles are then transported through hollow space 28 to garment 22 where they react with the garment. These ionic salts, fabric fresheners, fragrances and antistatic chemicals may be provided as packets 86 to be mixed with each new source of water 66.

Self-feeding steam generator 36 operates as follows. A measured source of water 66 is provided by the user to water reservoir chamber 64 through water filling port 63 in the bottom of steam generator 36. Ionic salts, fresheners, fragrances and antistatic chemicals to be mixed with water 66 may also be added to water reservoir 64 through water filling port 63. The user then seals water filling port 63 with replaceable plug 65. A measured amount of source of water 66 and entrapped air 68 are contained within water reservoir chamber 64. Steam generator 38 is now turned over. Water 66 and other dissolved chemicals flow through water communication port 74 into steam chamber 70. Simultaneously, bubbles 88 of air flow back into water reservoir chamber 64 to replace the volume of water transferred to steam chamber 70. This process continues until the water level in the steam chamber covers water communication port 74. At this point a pressure balance is achieved between water 66 in water reservoir chamber 64 and the water in steam chamber 70. Entrapped air 68 exerts a negative force on water 66 in water reservoir chamber 64 holding the water from all flowing into steam chamber 70. As steam 38 is generated, the water level in steam chamber 70 is lowered. When the water level in steam chamber 70 reaches the level of the water communication port 74, a bubble 88 of air is sucked into water reservoir chamber 64 and a volume of water equal to the volume of the bubble of air is provided to the steam chamber for conversion into steam 38. In this manner steam generator 36 self-feeds in periodic intervals a source of water 66 to be vaporized and produces a self-regulated rate of steam generation. Electrodes 80 generally extend from the bottom of steam chamber 70 to a height above water communication port 74. Having electrodes 80 that extend beyond the water level in the steam chamber allows for the steam generation rate to be regulated by the water level height. This process continues until the level of water 66 in water reservoir chamber 64 drops to the height of water communication port 74. When this state is reached, the remaining water 66 in steam chamber 70 is then converted to steam 38 and the steam generation process stops. Having a measured amount of water 66 limits the total amount of steam to be generated. As a result, steam generator 36 does not need to be monitored by the user and shuts off automatically when the water 66 in the steam chamber is consumed. Consumption of all water in steam chamber 70 creates an open circuit that stops the flow of electric current.

Figure 8:
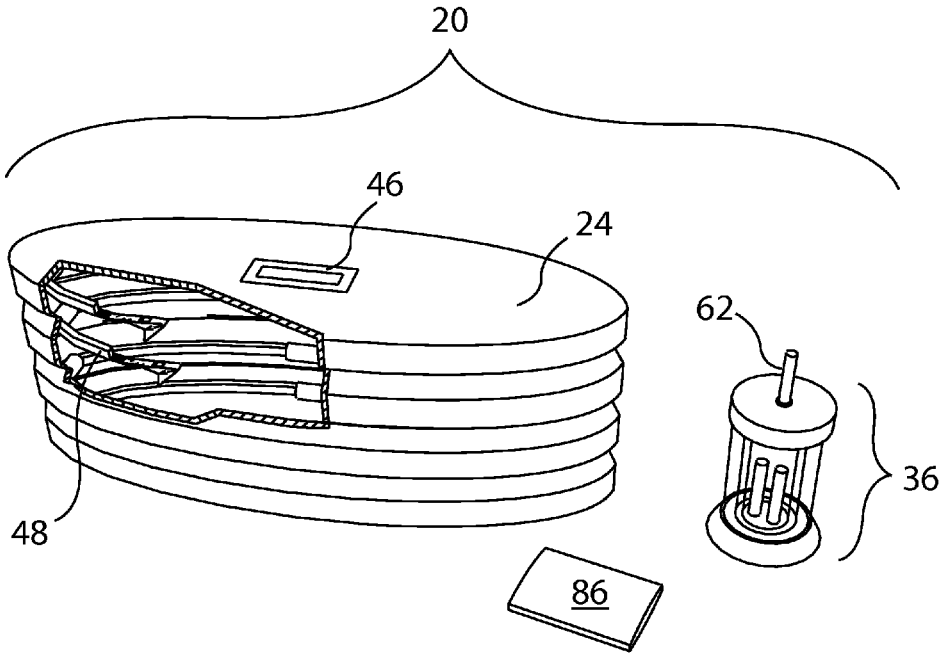
FIG. 8 is a front perspective view of the apparatus for steaming a garment of FIG. 1, the apparatus is now shown in an collapsed state allowing for easy storage.

General use and operation of garment steamer 20 is as follows. The compacted garment steamer 20 with associated components, as shown in FIG. 8, is unpacked by the user. Enclosure 24 is expanded and hung on a rack using enclosure hanging element 41. Re-closeable opening 30 is opened and garment 22 is hung on clothes hanging element 32. Stretch element(s) 48 are secured to garment 20 to stretch the fabric. Replaceable plug 65 is removed from the bottom of steam generator 36. Ionic salts and fabric freshener are placed through water filling port 63 into water reservoir chamber 64. A source of water 66 is further added to water fill line 67. Replaceable plug 65 is then placed back within water filling port 63 to seal water reservoir chamber 64. At this point, steam generator 36 may be shaken gently to mix the ionic salts, fabric freshener, fragrances and antistatic chemicals to create an ionic solution. Steam generator 36 is turned over and tube 62 is used to connect the steam generator to steam port 60 in the base of enclosure 24. Water 66 from water reservoir chamber 64 then flows through water communication port 74 filling steam chamber 70 with water to the height of the water communication port at which point the water stops flowing. The water 66, now mixed as an ionic solution, makes contact with electrodes 80 to create a closed circuit. Steam generator 36 is then connected to a power source 84. Electric current flows through the ionic solution causing water 66 to heat resistively and vaporize into steam. The steam is passed through steam port 60 and into enclosure 24 where it reacts with the fabric of garment 22 to steam and re-freshen the garment. Steam 38 also helps to expand enclosure 24 and create a gap 42 between garment 22 and inside wall 26. FIG. 5 illustrates operation of garment steamer 20 in this configuration. The user may then walk away and allow garment steamer 20 to complete the steaming and freshening process. During the steaming process, as water 66 evaporates from steam chamber 70, the water level in the steam chamber decreases until the water meets the height of water communication port 74. At this point a bubble 88 of air is sucked into water reservoir chamber 64 and the water flows into steam chamber 70 raising the water level just above the height of water communication port 74. Water 66 continues to self-feed into steam chamber 70 in this manner until the water level in water reservoir chamber 64 lowers to the height of water communication port 74. At this point no more water flows into steam chamber 70. The remaining water 66 in steam chamber 70 is then vaporized into steam 38. When all water 66 is vaporized, an open is created in the electrical circuit and garment steamer 20 automatically shuts off. The user then returns at a later time and opens re-closeable opening 30 and lets the garment dry. The refreshed and wrinkle free garment 22 is then removed from enclosure 24. The user may then place another garment 22 in the enclosure and repeat the steaming and freshening process on the new garment or the user may collapse an pack away garment steamer 20.

Additional embodiments of garment steamer 20 may include the following features. In one embodiment, enclosure 24 may take the form of a standard garment travel bag. In this embodiment garment steamer 20 serves both to act as a travel bag and a garment steamer and therefore requires no special packing for travel. In another embodiment, garment steamer 20 is provided with a removable absorbent pad that may be placed in the base of enclosure 24 for absorbing condensed water and other chemicals that may collect on the bottom of the enclosure during the steaming process.

While several embodiments of the invention, together with modifications thereof, have been described in detail herein and illustrated in the accompanying drawings, it will be evident that various further modifications are possible without departing from the scope of the invention. Nothing in the above specification is intended to limit the invention more narrowly than the appended claims. The examples given are intended only to be illustrative rather than exclusive.

What is claimed is:

1. An apparatus for steaming a garment, comprising:

a) an enclosure having a wall circumscribing a hollow space therein, said enclosure having a back, sides, front and length, said hollow space accessible through a re-closeable opening in said wall;

b) a steam generator connected to provide steam to said hollow space;

c) a clothes hanging element within said hollow space, said clothes hanging element for holding the garment; and d) a stretch element positioned within said enclosure, said stretch element including a rib bent to extend along said back and said sides, said stretch element terminating in two distal ends near said front, each distal end having an elastomeric strap with a clamping element for connection to the garment.

2. An apparatus as recited in claim 1, wherein said enclosure is expandable to create a gap between said enclosure and the garment.

3. An apparatus as recited in claim 1, wherein said enclosure is collapsible for compact storage.

4. An apparatus as recited in claim 1, wherein said enclosure is constructed of a breathable material to allow moisture in said steam to pass through said wall.

5. An apparatus as recited in claim 1, wherein said wall of said enclosure includes at least one pressure relief port.

6. An apparatus as recited in claim 1, wherein said enclosure further includes a steam port to connect said steam generator externally to said enclosure.

7. An apparatus as recited in claim 1, further comprising a plurality of said stretch elements, each stretch element spaced periodically and having a spacing width there between along said length of said enclosure, wherein said spacing width collapses and expands with the collapse and expansion of said enclosure.

8. An apparatus as recited in claim 1, wherein said stretch element is attached interior said hollow space to said wall of said enclosure.

9. An apparatus as recited in claim 1, wherein said stretch element fits internal the garment.

10. An apparatus as recited in claim 1, wherein said stretch element fits external the garment and creates a gap between the garment and said wall.

11. An apparatus as recited in claim 1, wherein said steam generator includes a water reservoir chamber and a steam chamber, wherein said steam generator self-feeds from said reservoir chamber to said steam chamber a source of water to be vaporized.

12. An apparatus as recited in claim 11, wherein said steam generator has a rate of steam generation, wherein said rate of stream generation is limited by the self-feeding of the source of water from said reservoir chamber to said steam chamber.

13. An apparatus as recited in claim 1, further comprising a removable absorbent pad placed on the bottom of the base of the enclosure.

14. An apparatus as recited in claim 1, further comprising an enclosure hanging element.

15. An apparatus for steaming a garment, comprising:

a) an enclosure having a wall circumscribing a hollow space therein, said hollow space accessible through a re-closeable opening in said wall;

b) a clothes hanging element within said hollow space, said clothes hanging element for holding the garment;

c) a steam generator connected to provide steam to said hollow space; and d) wherein said steam generator includes a steam chamber, a water reservoir chamber and a vertical partition there between; wherein said steam chamber includes at least one pair of electrodes; wherein said vertical partition has a water communication port located at a vertical height to allow for a source of water to pass from said water reservoir chamber to said steam chamber as the source of water in said steam chamber is converted to steam; wherein said vertical height determines a set level of water contacting said at least one pair of electrodes as the source of water is fed from said reservoir chamber to said steam chamber; wherein said water reservoir chamber seals to form an airtight chamber everywhere except for said water communication port.

16. An apparatus as recited in claim 15, wherein said steam generator holds a measured amount of water, wherein the measured amount of water is completely contained within said steam generator, wherein the measured amount of water limits the total amount of steam to be generated.

17. An apparatus as recited in claim 15, wherein the passage of the source of water from said water reservoir chamber to said steam chamber is actuated by a pressure difference between the steam chamber and water reservoir chamber, wherein said pressure difference is created by the evaporation of the steam.

18. An apparatus as recited in claim 15, wherein each said at least one pair of electrodes is arranged to provide electric current through the source of water placed within said steam generator to directly heat the water to generate the steam.

19. An apparatus as recited in claim 18, wherein said steam generator further includes a power source to provide the electric current.

20. An apparatus as recited in claim 15, wherein said steam generator further includes a water filling port with a replaceable plug.

21. An apparatus as recited in claim 15, further comprising an electrolytic material for mixing with the source of water placed within said steam generator; wherein said electrolytic material and the source of water create an ionic solution.

22. An apparatus as recited in claim 15, further comprising a fabric freshener for mixing with the source of water placed within said steam generator.

23. An apparatus as recited in claim 14, wherein said enclosure hanging element is a clothes hanger having a hooked top attached to a wide support structure, wherein said hooked top of said clothes hanger passes through the wall of said enclosure and said wide support structure is said clothes hanging element.

24. An apparatus as recited in claim 15, wherein said vertical height determines a constant rate of steam generation.

25. An apparatus as recited in claim 15, wherein the source of water is fed to said steam generator at periodic intervals as steam is generated.

26. An apparatus as recited in claim 25, wherein said periodic intervals occur from bubbles of air passing from said steam chamber to said reservoir chamber.

27. An apparatus for steaming a garment, comprising:

a) an enclosure having a wall circumscribing a hollow space therein, said hollow space accessible through a re-closeable opening in said wall;

b) a clothes hanging element within said hollow space, said clothes hanging element for holding the garment;

c) a steam generator connected to provide steam to said hollow space; and d) wherein said steam generator includes a steam chamber, a water reservoir chamber and a vertical partition there between; wherein said steam chamber is concentric with said reservoir chamber; wherein said vertical partition has a water communication port to allow for a source of water to pass from said water reservoir chamber to said steam chamber as the source of water in said steam chamber is converted to steam.

* * * * *